US011460278B2

(12) United States Patent
Keeney

(10) Patent No.: US 11,460,278 B2
(45) Date of Patent: Oct. 4, 2022

(54) MODULAR WEIGHT BROADHEAD

(71) Applicant: Bear Archery, Inc., Evansville, IN (US)

(72) Inventor: Sean M. Keeney, Henderson, KY (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 17/455,247

(22) Filed: Nov. 17, 2021

(65) Prior Publication Data

US 2022/0178662 A1 Jun. 9, 2022

Related U.S. Application Data

(60) Provisional application No. 63/202,895, filed on Jun. 29, 2021, provisional application No. 63/198,263, filed on Dec. 9, 2020.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 2,829,894 | A | 4/1958 | Henkel | |
| 5,269,534 | A * | 12/1993 | Saunders | F42B 6/08 473/582 |
| 7,318,783 | B2 | 1/2008 | Polando | |
| 7,883,435 | B2 | 2/2011 | Sullivan | |
| 9,097,500 | B1 | 8/2015 | Addleman | |
| 9,638,499 | B2 * | 5/2017 | Perry | F42B 6/04 |
| 9,915,510 | B1 * | 3/2018 | Huang | F42B 6/08 |
| 10,859,354 | B1 * | 12/2020 | Huang | F42B 6/08 |
| 2005/0181898 | A1 * | 8/2005 | Muller | F42B 6/08 473/578 |
| 2009/0163308 | A1 | 6/2009 | Odabachian et al. | |
| 2012/0028741 | A1 * | 2/2012 | Palomaki | F42B 6/08 473/582 |

* cited by examiner

*Primary Examiner* — John A Ricci
(74) *Attorney, Agent, or Firm* — Woodard, Emhardt, Henry, Reeves & Wagner, LLP

(57) ABSTRACT

Modular broadheads for use with an archery bow and arrow include interchangeable bases and tip portions which can be mixed and matched in various permutations as selected by an archer. An archer may conveniently switch between different types of broadheads on an arrow such as field points for target shooting, fixed blade broadheads for hunting, and/or mechanical blade broadheads for hunting without changing the broadhead weight. Alternately, an archer may conveniently change the weight at the front of the arrow by changing one or both of the base and tip portions.

20 Claims, 8 Drawing Sheets

MODULAR WEIGHT BROADHEAD

CROSS-REFERENCE TO RELATED APPLICATIONS

This application claims the benefit of U.S. Provisional Patent Application Ser. No. 63/198,263 filed on Dec. 9, 2020 and U.S. Provisional Patent Application Ser. No. 63/202,895 filed on Jun. 29, 2021, both of which are incorporated herein by reference.

FIELD OF ENDEAVOR

This disclosure relates broadly to broadheads for arrows and more particularly to modular weight broadheads.

BACKGROUND

In archery, an arrow is equipped with a point or head that engages a target, referred to herein as broadheads. For example, an archer may use field points without blades for target shooting, fixed blade broadheads for hunting, and/or mechanical bladed broadheads for hunting. In selecting an arrow and broadhead, an archer may desire to adjust the tip type or the front-of-center (FOC) weight of an arrow. For instance, when hunting big game an archer may desire a heavier grain weight arrow than when hunting smaller game. It is desirable to have a convenient method of switching an arrow to use a different type of tip and/or switching to a different amount of weight located at the front of the arrow.

SUMMARY

Various embodiments of the present disclosure include modular broadheads for use with an archery bow and arrow that include interchangeable bases and tip portions which can be mixed and matched in various permutations as selected by an archer. As one aspect, an archer may conveniently switch between different types of broadheads on an arrow such as field points for target shooting, fixed blade broadheads for hunting, and/or mechanical broadheads for hunting. Alternately, an archer may conveniently change the weight at the front of the arrow by changing one or both of the base and tip portions.

An illustrative method for mounting a broadhead on an arrow shaft with an open hollow end and a threaded insert extending into an interior of the arrow shaft, includes threadably mounting a rearward extending tail portion of a first base to the threaded insert, the first base having a forward extending mounting section and the first base having a first base weight. Selecting a first tip portion of a first type from a group of interchangeable tip portions with the same weight, wherein the group consists of at least two different types of tip portions selected from the group consisting of field tip portions, fixed blade tip portions and mechanical blade tip portions. Each tip having a barrel defining a hollow interior with an open rear end configured to receive the forward extending mounting section of the first base. Mounting the selected first tip portion to the first base, wherein the hollow interior of the barrel receives and connects to the forward extending mounting section of the first base. Selecting a second tip portion of a second type from the group of interchangeable tip portions; and replacing on the first base the selected first tip portion of the first type with the selected second tip portion of the second type.

An alternate method for mounting a broadhead on an arrow shaft with an open hollow end and a threaded insert extending into an interior of the arrow shaft, include selecting a first base from a group consisting of interchangeable bases with different weights, each base including a forward extending mounting portion. Threadably mounting the selected base to the threaded insert. Selecting a first tip portion from a group consisting of interchangeable tip portions of different types, each tip portion defining a hollow interior with an open rear end configured to receive the forward extending portion of a base. Mounting the first selected tip portion to the first selected base, and replacing on the arrow shaft at least one of the selected first base and the selected first tip portion with a selected second base with a different weight or a selected second tip portion with a different weight without changing the other of the selected first base and the selected first tip portion.

A another illustrative method for mounting a broadhead on an arrow shaft with an open hollow end and a threaded insert extending into an interior of the arrow shaft includes threadably mounting a rearward extending tail portion of a first base to the threaded insert. The first base having a forward extending mounting section with a conical tapered profile and an externally threaded mounting section; and threadably mounting a first tip portion having a barrel to the forward extending mounting section of the first base, the barrel defining a hollow conical interior profile sized to receive and mate with the conical tapered profile of the forward extending mounting section, the barrel defining an internally threaded interior portion to threadably connect to the threaded mounting section of the first base.

Other objects and attendant advantages will be readily appreciated as the same become better understood by references to the following detailed description when considered in connection with the accompanying drawings.

DETAILED DESCRIPTION OF EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates Various embodiments of the present disclosure include methods of mounting modular broadheads for use with an archery bow and arrow. The primary types of archery bows include recurve bows, compound bows and crossbows. The broadheads include interchangeable bases and tip portions which can be mixed and matched in various permutations as selected by an archer. As one aspect, an archer may conveniently switch between different types of broadheads on an arrow while maintaining a consistent weight such as field points for target shooting, fixed blade broadheads for white-tail deer hunting, and/or mechanical broadheads for big game hunting. As another aspect, an archer may conveniently change the weight at the front of the arrow by changing one or both of the base and tip portions.

Directional references herein are for ease of explanation and are not intended to be limiting.

Figure 1:
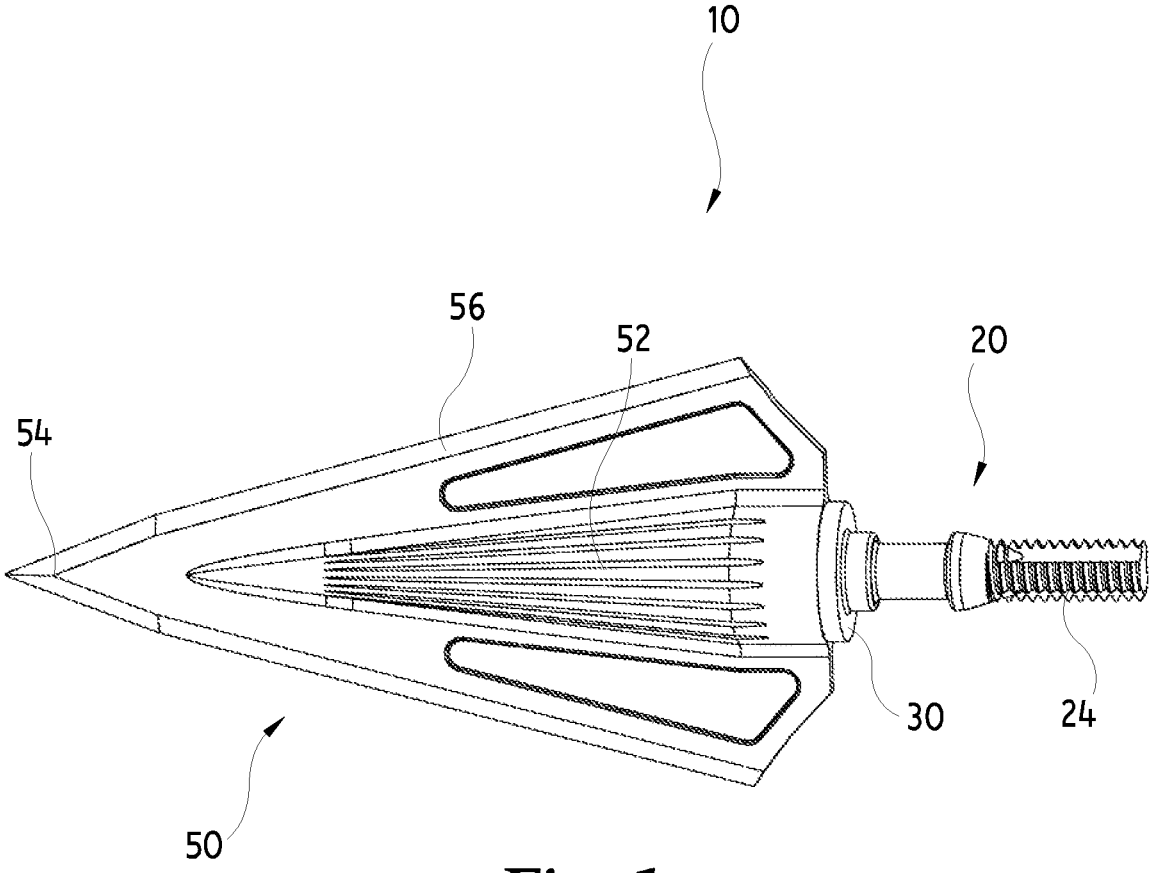
FIG. 1 is a side view of a broadhead according to an embodiment of the disclosure.
Figure 2:
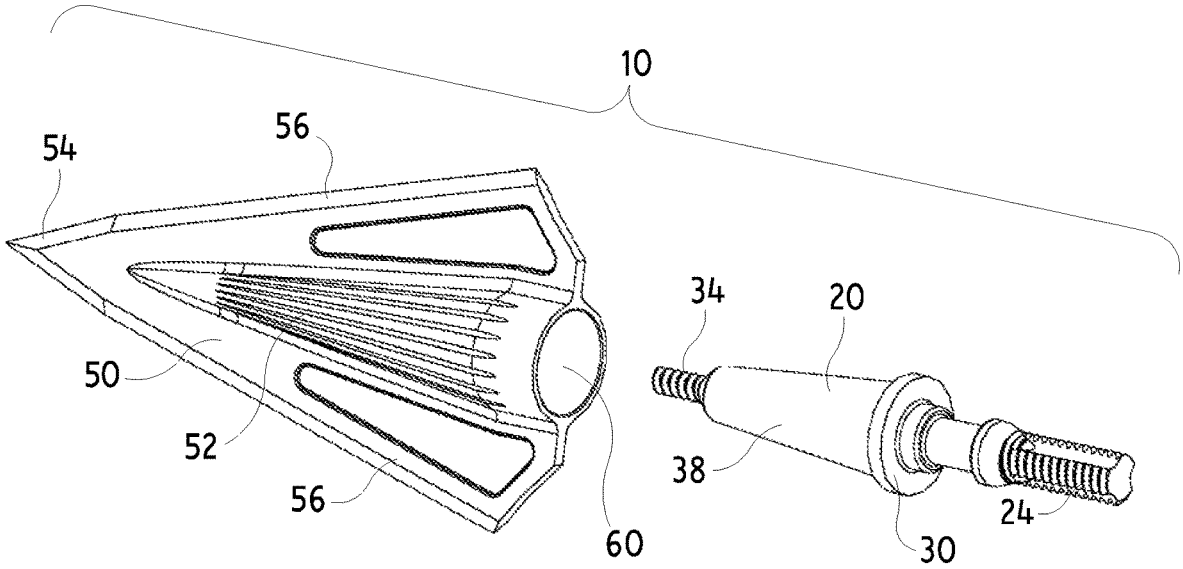
FIG. 2 is a perspective exploded view of the broadhead of FIG. 1
Figure 3:
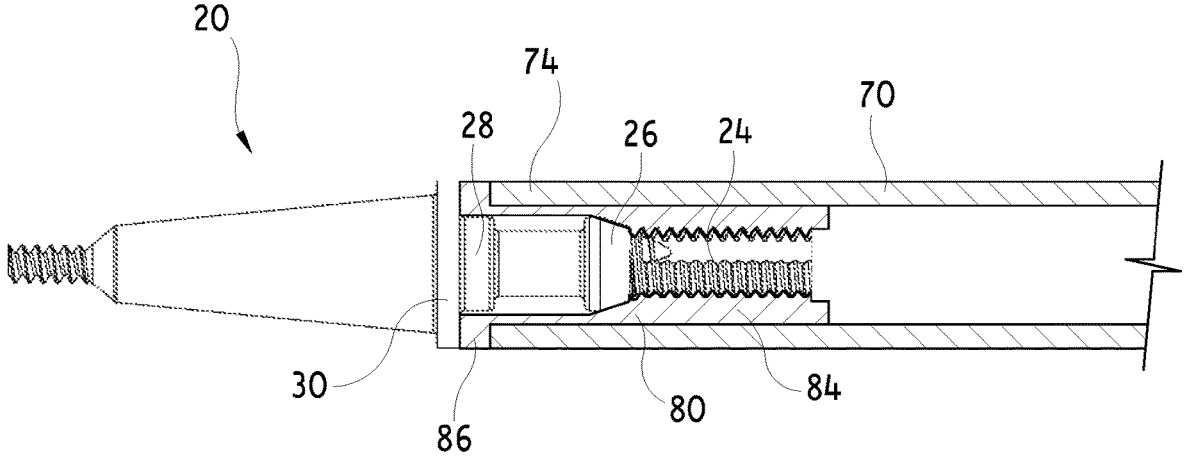
FIG. 3 is a cross-sectional view of the base of the broadhead of FIG. 1 with an arrow shaft.

FIGS. 1-2 show an embodiment of a broadhead generally designated 10. The broadhead 10 is adapted for mounting to an open end of a hollow arrow shaft, typically to an insert mounted to the shaft. Broadhead 10 includes a base 20 removably mounted on a tip portion 50. FIG. 3 illustrates base 20 mounted to an arrow shaft 70.

Arrow shaft 70 includes an open forward end 74. An insert 80 is mounted to forward end 74 and extends into the interior of shaft 70. Insert 80 is typically fixed in place on shaft 70, for example with adhesive. Insert 80 includes an interior portion including rear portion 84. Rear portion 84 may be internally threaded to receive the stem of a broadhead or a base. Insert 80 includes a forward shoulder portion 86. Shoulder portion 86 is exterior to shaft 70, with a rear face of the shoulder portion 86 abutting a forward face of shaft end 74. Typically shoulder portion 86 has an outer diameter matching the outer diameter of arrow shaft 70.

Figure 4A:
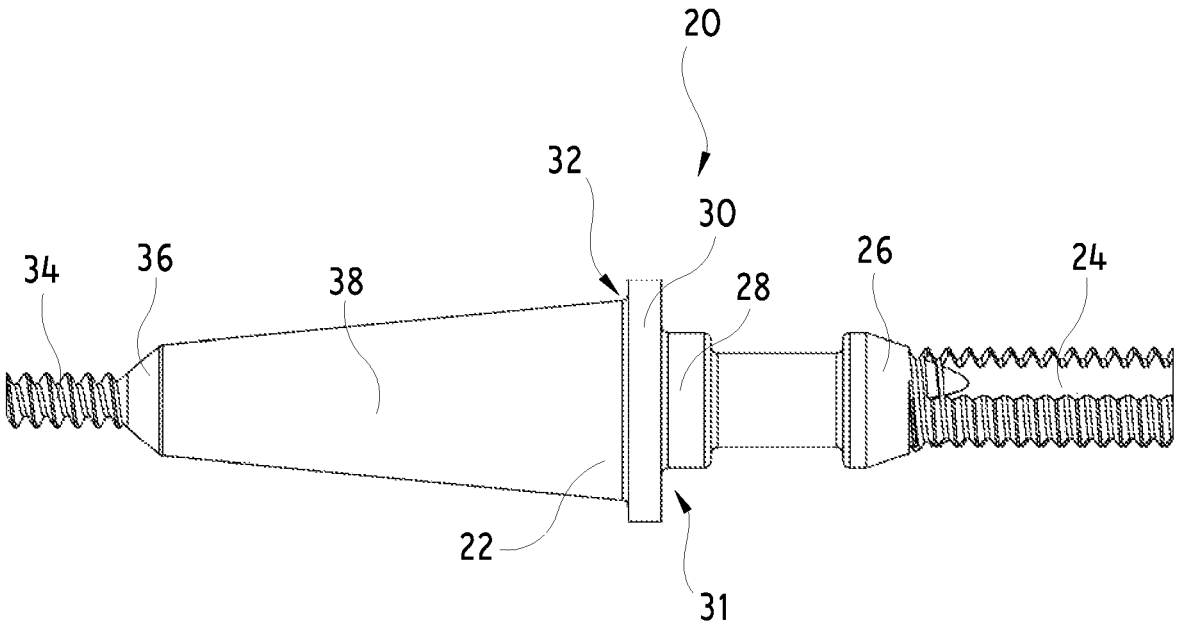
FIG. 4A is a side view of the base of the broadhead of FIG. 1.

As illustrated in detail in FIG. 4A, base 20 is formed with a body section 22. A shoulder 30 is formed along an interim portion of body section 22. A stem extends rearward from shoulder 30, forming a tail portion 24 which can be removably secured to an arrow shaft 70 as seen in FIG. 3. In the illustrated embodiment, tail portion 24 is exteriorly threaded to threadably mate with rear portion 84 of insert 80. In other forms, base 20 may be mounted to an arrow shaft in other manners, such as with mechanical fasteners, releasable adhesives, mounting on a ferrule or arrow shaft insert, or using other attachment techniques.

Figure 4B:
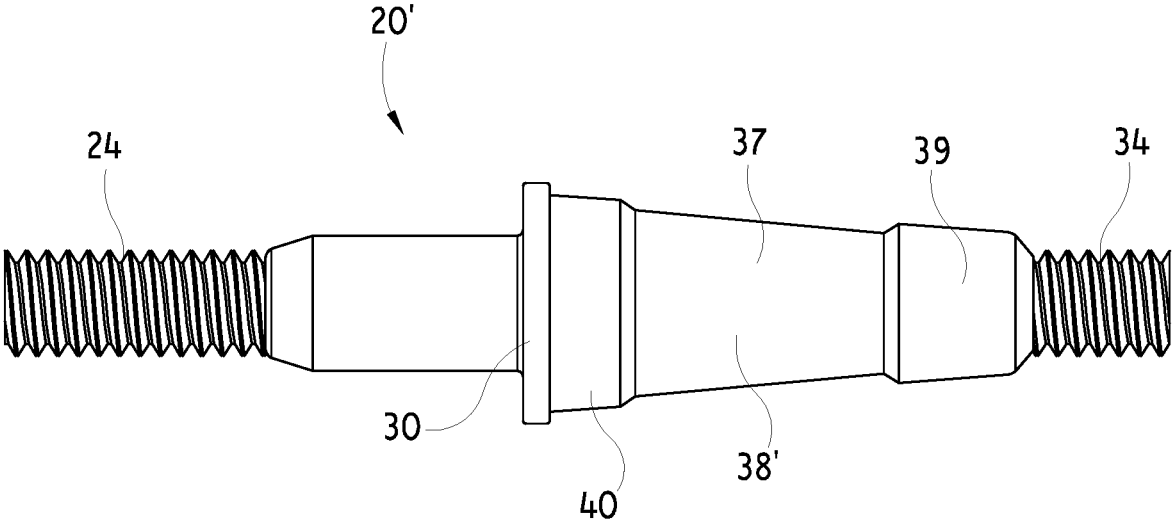
FIG. 4B is a side view of an alternate embodiment of the base of the broadhead of FIG. 1.

A pair of alignment portions 26, 28 are arranged on the stem between tail portion 24 and shoulder 30. An optional reduced diameter stem section between alignment portion 26, 28 removes mass and weight. Preferably alignment portions 26, 28 each have an outer diameter sized to snugly fit within the inner diameter of insert 80 to align and brace base 20 along a central axis of arrow shaft 70. In some embodiments, flexible O-rings may be mounted with or adjacent alignment portions 26, 28 to assist in holding base 20 in alignment and sealing the connection. In alternate embodiments, such as shown in FIG. 4B, base 20' illustrates a stem with a constant diameter section between tail portion 24 and shoulder 30.

A mounting section of base 20 extends forward from shoulder 30 to a forward end 34. Forward end 34 is configured to be secured to a tip portion 50. In the illustrated embodiment, forward end 34 is externally threaded to threadably mate with a tip portion 50. A shaft section 38 extends between shoulder 30 and forward end 34. Shaft section 38 is sized to match an interior profile of a tip portion. In the illustrated embodiment, shaft section 38 is formed as a tapered cone. A sloped portion 36 may form a transition between forward end 34 and shaft section 38.

In certain embodiments, the base is selected from a group consisting of interchangeable bases with different weights. FIG. 4B illustrates base 20' as an alternate embodiment of base 20 shown in FIG. 4A. In base 20' shaft section 38' has a central portion 37 with a reduced diameter profile. The reduced diameter portion 37 is spaced between a forward shoulder 39 and a rearward shoulder 40 with larger profiles. Forward shoulder 39 and rearward shoulder 40 have tapered diameters matching corresponding locations on shaft section 38 of base 20, allowing base 20' to fit the same tip portions as base 20 yet with less mass and less weight than base 20. In other respects, base 20' has the same features and is interchangeable with base 20. In selected embodiments, different bases can be made of different metals and/or with different densities to define their weight. Similarly, different tip portions can be made of different metals and/or with different densities to define their weight Shoulder 30 defines a rearward face 31 which typically abuts a forward face of arrow shaft 70 or more directly insert 80, when broadhead 10 is mounted to arrow shaft 70. Shoulder 30 also defines a forward face 32 which may abut a rear face of tip portion 50 when broadhead 10 is assembled.

Different types of tip portions include field tip portions, fixed blade tip portions and mechanical blade tip portions. Field tip portions do not have blades and are primarily used for target practice. In certain embodiments, the tip portions are selected from a group consisting of at least two different types of tip portions having the same weight. For instance, the first tip portion may have two blades and a second tip portion with the same weight may have three blades. Alternately, the first tip portion may have fixed blades while a second tip portion with the same weight has mechanical blades. Still alternately, the first tip portion may be a field tip portion while a second tip portion with the same weight has fixed or mechanical blades. In alternate embodiments, the tip portion is selected from a group consisting of interchangeable tip portions with different weights. The tip portions with different weights may be the same type of tip portions or different types of tip portions.

As illustrated in detail in FIGS. 1 and 2 among others, tip portion 50 includes a central barrel 52. Barrel 52 extends forward to a point or tip 54. The interior of barrel 52 may have a tapered conical profile to match the tapered conical profile of shaft section 38 of base 20. Barrel 52 may also have a tapered external profile for aerodynamics. In alternate embodiments, barrel 52 may have other profiles such as a cylinder.

In field point versions, tip portion 50 includes a barrel 52 and tip 54 without blades. In non-field point versions, a plurality of sharpened blades 56 extend rearward from tip 54 and radially from barrel 52. In the embodiment illustrated in FIG. 1, two fixed blades 56 are illustrated. In alternate embodiment, three or four blades may be used. In further embodiments, mechanical blades may be used. Mechanical blades are typically placed in a closed, smaller diameter position for storage and flight, yet deploy to create a larger cutting diameter upon impact with a target. Mechanical blades may forwardly deploy, where the tips are oriented forward and rotate outward and rearward upon impact, or may rearwardly deploy, where the tips are oriented rearward and rotate outward upon impact.

In some embodiments blades 56 are fixed and formed integrally with barrel 52. In other embodiments, blades 56 are permanently mounted to barrel 52 such as by welding, fusion, soldering or adhesive. In still alternate embodiments, blades 56 may be replaceably mounted to barrel 52. In a mechanical version, the blades are pivotally mounted to the barrel, for instance using a hinge pin. A frangible retaining element, such as an elastic band or plastic clip may assist in holding the mechanical blades in the stored position until impact.

Figure 5:
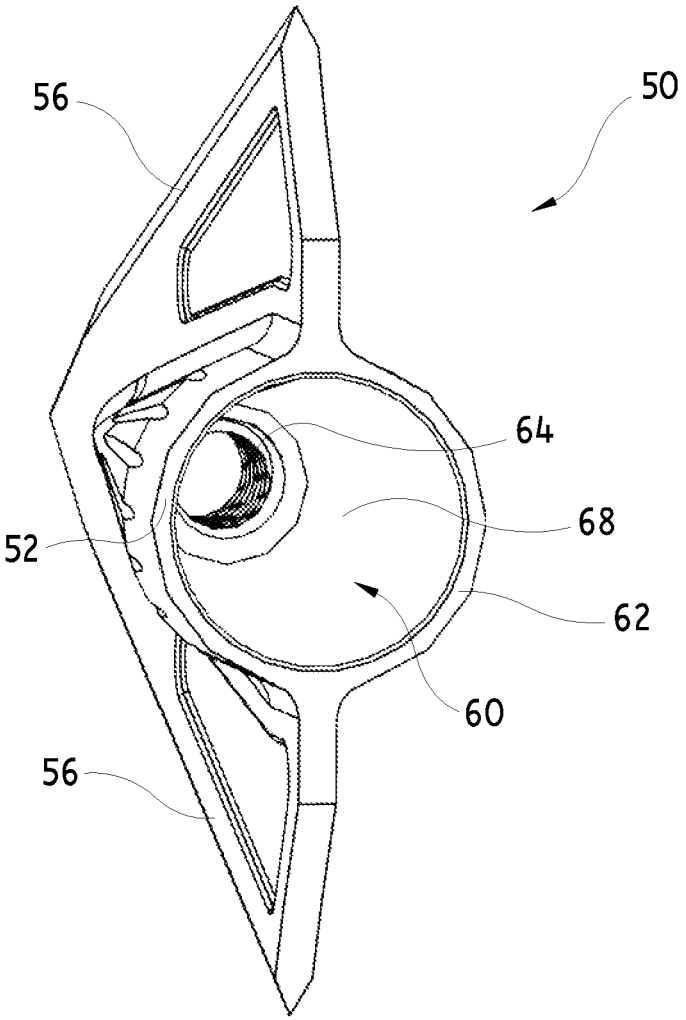
FIG. 5 is a perspective rear view of the tip portion of the broadhead of FIG. 1.

As illustrated in FIG. 5, barrel 52 defines a hollow interior with an open rear end 60 to receive and connect to the forward extending mounting section of base 20. A forward section 64 within barrel 52 is configured to selectively fasten to the mounting section. In the illustrated embodiment, forward section 64 is internally threaded to mate with an externally threaded forward end 34 of base 20. Forward end 34 and forward section 64 may be cylindrical. In alternate embodiments, other fastening arrangements, such as non-permanent adhesive, a set screw, a transverse pin or other mechanical fasteners may be used.

Barrel 60 further includes a transition section 68 extending internally from a rear face 62 to forward section 64. In the illustrated embodiment, transition section 68 is formed as the interior surface of a tapered cone sized to mate with an exterior tapered cone surface of base shaft section 38. In alternate embodiments, transition section 68 and shaft section 38 may have other profiles, such as cylindrical. Alternately, a polygonal or non-circular profile could be used to secure the tip portion in a desired angular orientation relative to the base. In a polygonal or non-circular profile arrangement, the tip portion and base would be fastened together with an alternative to a direct threaded connection.

Figure 6:
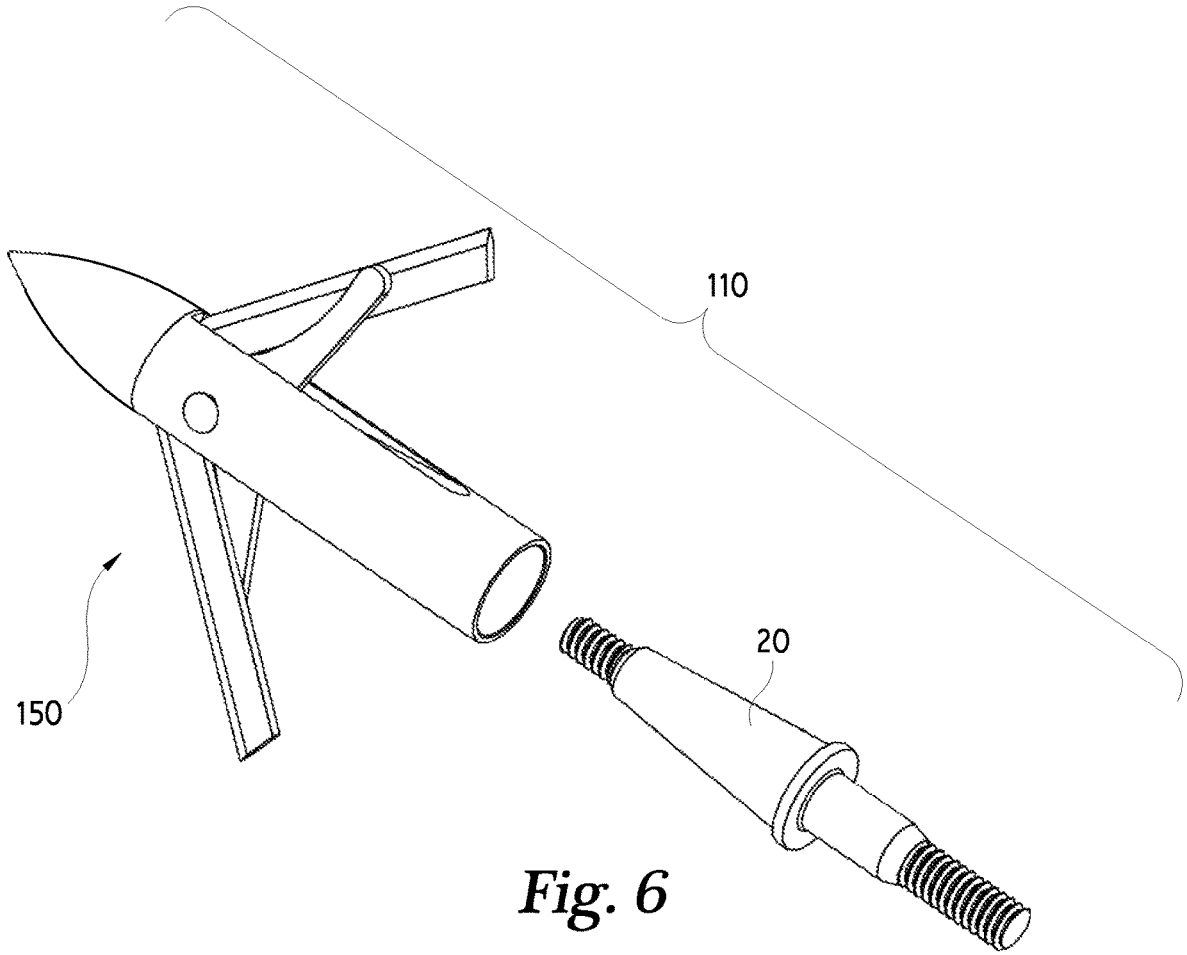
FIG. 6 is a perspective exploded view of a mechanical broadhead according to an embodiment of the disclosure.

FIG. 6 illustrates a representative embodiment of a mechanical broadhead 110 with rearward expanding blades. Broadhead 110 includes tip portion 150 which may be mounted on modular base 20.

Figure 7:
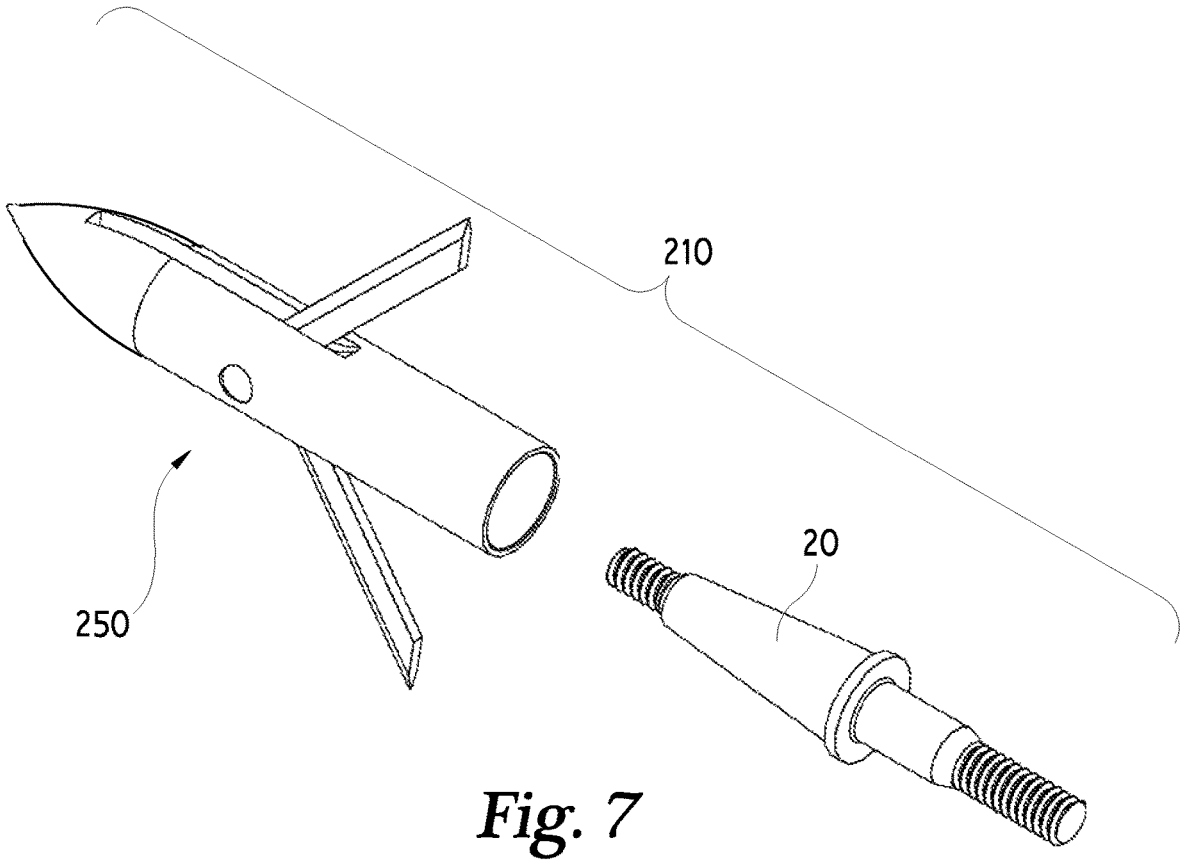
FIG. 7 is a perspective exploded view of a mechanical broadhead according to an embodiment of the disclosure.

FIG. 7 illustrates a representative embodiment of a mechanical broadhead 210 with forward opening blades. Broadhead 210 includes tip portion 250 which may be mounted on modular base 20.

Figure 8:
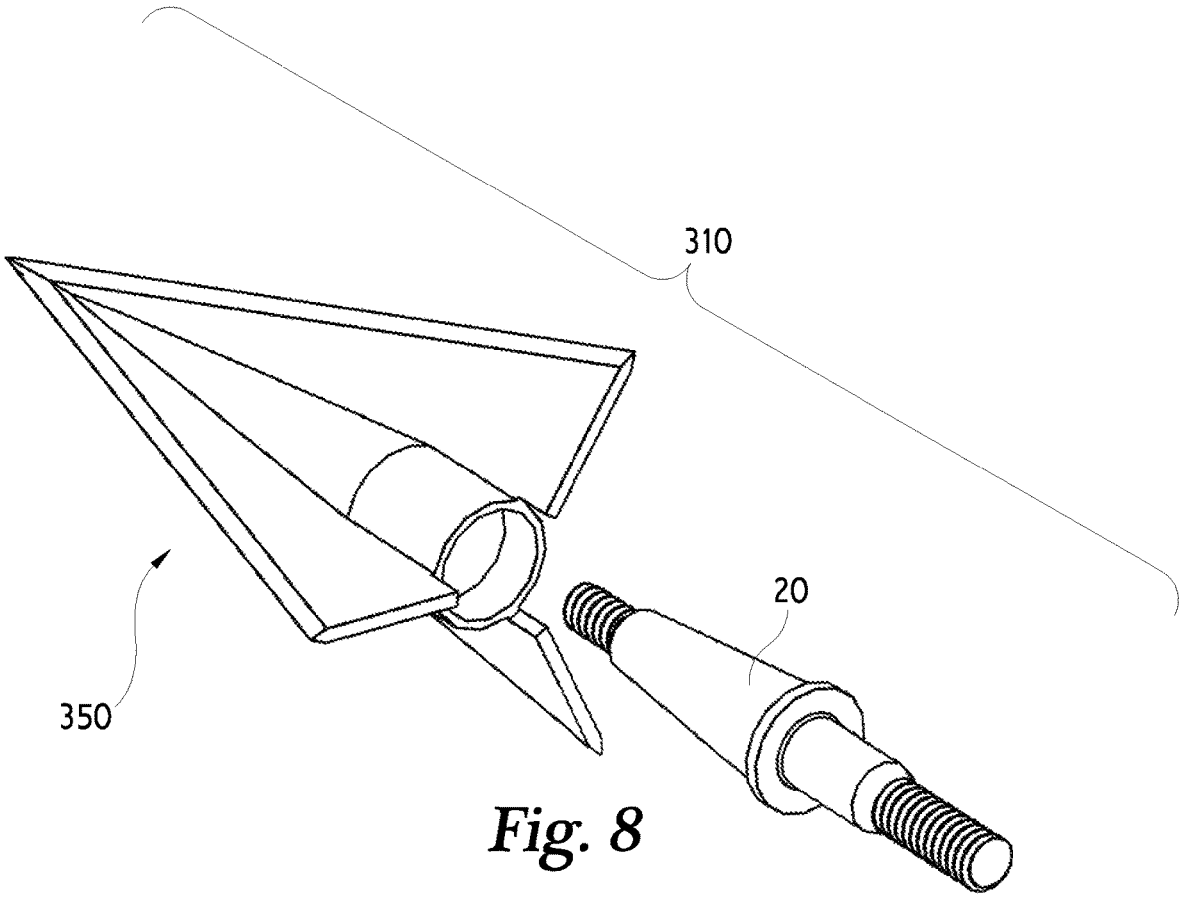
FIG. 8 is a perspective exploded view of a fixed blade broadhead according to an embodiment of the disclosure.

FIG. 8 illustrates a representative embodiment of a broadhead 310 with three fixed blades. Broadhead 310 includes tip portion 350 which may be mounted on modular base 20.

The modular weight broadheads may include multiple bases and/or tip portions which are modularly interchangeable, allowing the tip portions and bases to be mixed and matched, for instance to adjust the tip type, the total weight and the front-of-center (FOC) weight of an arrow. For example, a base may have a weight of 25 grains. Tip portions of 75 grains or 100 grains may be mounted on the 25 grain base to form either a 100 grain or 125 grain broadhead. Alternately, changing a 25 grain base to a 50 grain base in combination with a 75 grain tip may change the broadhead weight from 100 grains to 125 grains. Tip portions and bases may be weighted and combined in other grain weights and total weight combinations as desired. Representative examples include bases with weights of 25, 50, 75, 100, 125 or 150 grains and tip portions with weights of 25, 50, 75, 100, 150 or more grains, creating combined broadheads between 100 and 300 grains. The grain weights herein are for purposes of illustration and are not intended to be limited.

In certain embodiments, the bases and tip portions are each marked with visual indicia so an archer may visually differentiate between bases and tips with different weights. The indicia may be alphanumeric characters, a symbol, a color or other visually distinguishing feature. An example indicia is the numerical grain weight of the component.

An illustrative method for mounting a broadhead on an arrow shaft with an open hollow end and a threaded insert extending into an interior of the arrow shaft, includes threadably mounting a rearward extending tail portion of a first base to the threaded insert, the first base having a forward extending mounting section and the first base having a first base weight. Selecting a first tip portion of a first type from a group of interchangeable tip portions with the same weight, wherein the group consists of at least two different types of tip portions selected from the group consisting of field tip portions, fixed blade tip portions and mechanical blade tip portions. Each tip having a barrel defining a hollow interior with an open rear end configured to receive the forward extending mounting section of the first base. Mounting the selected first tip portion to the first base, wherein the hollow interior of the barrel receives and connects to the forward extending mounting section of the first base. Selecting a second tip portion of a second type from the group of interchangeable tip portions; and replacing on the first base the selected first tip portion of the first type with the selected second tip portion of the second type.

Certain methods include providing a second base having a tail portion configured to be threadably secured to the threaded insert, the second base having a mounting section extending to a forward end, and the second base having a second base weight different than a first base weight. The method may include removing a first base from the end of the arrow shaft and mounting the second base to the end of the arrow shaft.

While the embodiments have been illustrated and described in detail in the drawings and foregoing description, the same is to be considered as illustrative and not restrictive in character, it being understood that only the preferred embodiments have been shown and described and that all changes and modifications that come with the spirit of the disclosure are desired to be protected.

What is claimed is:

1. A method for mounting a broadhead on an arrow shaft with an open hollow end and a threaded insert extending into an interior of the arrow shaft, comprising:

a. threadably mounting a rearward extending tail portion of a first base to the threaded insert, the first base having a forward extending mounting section and the first base having a first base weight;

b. selecting a first tip portion of a first type from a group of interchangeable tip portions with the same weight, wherein the group consists of at least two different types of tip portions selected from the group consisting of field tip portions, fixed blade tip portions and mechanical blade tip portions, each tip portion having a barrel defining a hollow interior with an open rear end configured to receive the forward extending mounting section of the first base, c. mounting the selected first tip portion to the first base, wherein the hollow interior of the barrel receives and connects to the forward extending mounting section of the first base;

d. selecting a second tip portion of a second type from the group of interchangeable tip portions; and e. replacing on the first base the selected first tip portion of the first type with the selected second tip portion of the second type.

2. The method of claim 1, a. wherein the mounting section of the first base has a forward extending conical tapered profile; and b. wherein the first tip portion defines a hollow conical interior profile sized to receive and mate with the conical tapered profile of the mounting section.

3. The method of claim 2, wherein the forward extending conical tapered profile of the first base defines a central portion with a reduced diameter profile spaced between a forward shoulder and a rearward shoulder with larger profiles, wherein the forward shoulder and rearward shoulder profiles are sized to mate with the hollow conical interior profile of the first tip portion.

4. The method of claim 2, a. wherein the mounting section of the first base has an externally threaded mounting section; and b. wherein the first tip portion defines an internally threaded interior portion to threadably connect to the threaded mounting section of the first base.

5. The method of claim 1, wherein the first tip portion has two blades and the second tip portion with the same weight has three blades.

6. The method of claim 1, wherein the first tip portion has fixed blades and the second tip portion with the same weight has mechanical blades.

7. The method of claim 1, wherein the first tip portion is a field tip portion and the second tip portion with the same weight has fixed or mechanical blades.

8. A method for mounting a broadhead on an arrow shaft with an open hollow end and a threaded insert extending into an interior of the arrow shaft, comprising:

a. selecting a first base from a group consisting of interchangeable bases with different weights, each base including a forward extending mounting portion;

b. threadably mounting the selected first base to the threaded insert;

c. selecting a first tip portion from a group consisting of interchangeable tip portions of different types, each tip portion defining a hollow interior with an open rear end configured to receive the forward extending portion of a base;

d. mounting the selected first tip portion to the selected first base, and e. replacing on the arrow shaft at least one of the selected first base and the selected first tip portion with a selected second base with a different weight or a selected second tip portion with a different weight without changing the other of the selected first base and the selected first tip portion.

9. The method of claim 8, wherein the forward extending mounting portions of the bases are threadably connectable to threaded sections within the hollow interiors of the tip portions.

10. The method of claim 8, wherein the hollow interiors of the tip portions have a tapered conical interior profile which matches a tapered exterior conical profile of the forward extending mounting portions of the bases.

11. The method of claim 8, wherein the group of interchangeable tip portions includes at least one tip portion with fixed blades and at least one tip portion with pivotable mechanical blades, and a. replacing on the arrow shaft a first tip portion with fixed blades with a second tip portion with pivotable mechanical blades; or b. replacing on the arrow shaft a first tip portion with pivotable mechanical blades with a second tip portion having fixed blades.

12. The method of claim 8, wherein the group of interchangeable bases comprises at least two different weights selected from a group consisting of 25, 50, 75, 100, 125 and 150 grains.

13. The method of claim 8, wherein the group of interchangeable tip portions comprises at least two different weights selected from a group consisting of 25, 50, 75, 100, and 150 grains.

14. The method of claim 8, wherein the group of interchangeable bases are marked with indicia to visually differentiate bases of different weights.

15. The method of claim 8, wherein the group of interchangeable tip portions are marked with indicia to visually differentiate tip portions of different weights.

16. A method for mounting a broadhead on an arrow shaft with an open hollow end and a threaded insert extending into an interior of the arrow shaft, comprising:

a. threadably mounting a rearward extending tail portion of a first base to the threaded insert, the first base having a forward extending mounting section with a conical tapered profile and an externally threaded mounting section; and b. threadably mounting a first tip portion having a barrel to the forward extending mounting section of the first base, the barrel defining a hollow conical interior profile sized to receive and mate with the conical tapered profile of the forward extending mounting section, the barrel defining an internally threaded interior portion to threadably connect to the threaded mounting section of the first base.

17. The method of claim 16, wherein the first base is selected from a group consisting of interchangeable bases with different weights.

18. The method of claim 16, wherein the first tip portion is selected from a group consisting of interchangeable tip portions with different weights.

19. The method of claim 16, wherein the first tip portion is selected from a group consisting of at least two different types of tip portions having the same weight.

20. The method of claim 19, comprising replacing on the first base the selected first tip portion of a first type with a selected tip portion tip of a second type.

* * * * *